US007287297B2

(12) United States Patent
Okano et al.

(10) Patent No.: US 7,287,297 B2
(45) Date of Patent: Oct. 30, 2007

(54) PRESSURE PAD FOR CLEANING FABRIC

(75) Inventors: Masao Okano, Toride (JP); Yoshitaka Yugami, Shizuoka (JP); Ryozo Suzuki, Saitama (JP)

(73) Assignee: Baldwin-Japan Ltd., Tokyo (JP)

( * ) Notice: Subject to any disclaimer, the term of this patent is extended or adjusted under 35 U.S.C. 154(b) by 267 days.

(21) Appl. No.: 10/829,049

(22) Filed: Apr. 21, 2004

(65) Prior Publication Data

US 2004/0211328 A1 Oct. 28, 2004

(30) Foreign Application Priority Data

Apr. 22, 2003 (JP) ..... 2003-117350

(51) Int. Cl.
*B08B 1/02* (2006.01)
*B41F 35/00* (2006.01)
*B41L 41/00* (2006.01)

(52) U.S. Cl. ..... 15/256.51; 15/256.5; 101/425

(58) Field of Classification Search ..... 15/256.5, 15/258.51; 101/425

See application file for complete search history.

(56) References Cited

U.S. PATENT DOCUMENTS 5,275,104 A * 1/1994 Corrado et al. ..... 101/425
5,289,774 A 3/1994 Stanka
5,519,914 A 5/1996 Egan
5,762,000 A 6/1998 Detmers
5,931,096 A 8/1999 Detmers et al.
6,061,867 A 5/2000 Schorpp et al.

FOREIGN PATENT DOCUMENTS

DE 2813672 4/1979
EP 0435269 3/1991
JP 7-40530 2/1995

* cited by examiner

*Primary Examiner*—Randall Chin
(74) *Attorney, Agent, or Firm*—Morgan & Finnegan LLP

(57) ABSTRACT

A cleaning apparatus includes a pressure pad for a cleaning fabric. The pressure pad comprises a particular portion formed on a base portion. The base portion has a predetermined hardness. The particular portion has a predetermined hardness which is lower than the hardness of the base portion. The cleaning fabric is nipped between the particular portion and a subject to clean the subject with the cleaning fabric.

11 Claims, 7 Drawing Sheets

PRESSURE PAD FOR CLEANING FABRIC

FIELD OF THE INVENTION

The invention relates to a pressure pad for a cleaning fabric. In addition, the invention relates to a cleaning apparatus including the pressure pad. The pressure pad and the cleaning apparatus are useful to clean the outer surface of a plate cylinder in an offset printing press. The pressure pad and the cleaning apparatus can be used to clean the outer surface of a blanket cylinder, impression cylinder or inking roller in the offset printing press. The pressure pad and the cleaning apparatus can also be used to clean the surface of a paper to be printed.

PRIOR ART

A direct imaging printing method has heretofore been utilized for making a printing plate after being put on a plate cylinder in an offset printing press. The printing plate includes an ink repellent silicon layer which is peeled off partially by laser. In this case, it is required to clean the outer surface of the plate cylinder to remove silicon particles issued from the silicon layer. In this connection, U.S. Pat. No. 6,061,867 discloses a brush having a special structure for cleaning the outer surface of the plate cylinder. U.S. Pat. No. 5,931,096 discloses a cleaning fabric formed of special fibers for cleaning the outer surface of the plate cylinder. However, the brush is expensive due to the special structure to be high in installation cost. The cleaning fabric is also expensive due to the special fibers to be high in running cost.

On the other hand, Japanese Laid-Open Patent Publication No. 40,530 of February 1995 discloses a cleaning apparatus for cleaning the outer surface of a plate cylinder. The cleaning apparatus includes a cleaning fabric which is nipped between a pressure pad and the outer surface of the plate cylinder to clean the outer surface of the plate cylinder with the cleaning fabric. However, the cleaning apparatus is inadequate to clean the outer surface or printing plate of the plate cylinder involving the silicon layer and the silicon particles. The printing plate may be scratched and damaged with the silicon particles sandwiched between the cleaning fabric and the printing plate by reason that the cleaning fabric is pressed hard against the printing plate by the pressure pad.

U.S. Pat. No. 5,289,774 discloses a cleaning apparatus for cleaning a paper to be printed. The cleaning apparatus includes a cleaning fabric nipped between a pressure pad and the paper to clean the paper with the cleaning fabric. However, lint may be taken off the paper too much by the cleaning fabric pressed hard against the paper by the pressure pad. The paper may be shaggy by the cleaning fabric. The paper is therefore lowered in quality.

It is therefore an object of the invention to provide a new and improved pressure pad for a cleaning fabric, which is arranged to clean a subject and overcome the above problems.

Another object of the invention is to provide the pressure pad to be low in installation cost and running cost.

Another object of the invention is to provide the pressure pad to keep the subject from being lowered in quality.

SUMMARY OF THE INVENTION

According to the invention, the pressure pad comprises a particular portion formed on a base portion. The base portion has a predetermined hardness. The particular portion has a predetermined hardness which is lower than the hardness of the base portion. The cleaning fabric is nipped between the particular portion and a subject to clean the subject with the cleaning fabric.

In a preferred embodiment, the base portion is formed of rubber. The particular portion is also formed of rubber.

The particular portion and the base portion are formed integrally with each other by being pressed with a predetermined high pressure and under a predetermined high temperature.

The base portion has a predetermined width and includes opposite side portions to be fixed. The particular portion has a predetermined width which is less than the width of the base portion, to be positioned between the opposite side portions of the base portion.

The base portion has a predetermined length and includes opposite end portions. The particular portion has a predetermined length which is less than the length of the base portion, to be positioned between the opposite end portions of the base portion.

A hollow portion may be formed between the particular portion and the base portion.

The base portion may be formed into a flat board.

The base portion may be formed to be channel shaped. The particular portion is disposed outwardly of the base portion.

The base portion may further includes a specified surface formed between the opposite side portions and opposed to the subject. The particular portion comprises a layer extending throughout the specified surface of the base portion.

The base portion may be cylindrical or semi cylindrical.

The particular portion may comprise a layer extending circumferentially of the base portion when the base portion is cylindrical or semi cylindrical.

According to the invention, there is also provided a cleaning apparatus including the pressure pad. The base portion is deformed and curved to be convex when being formed into a flat board. The particular portion is disposed outwardly of the base portion. The apparatus further includes a support bar including opposite side surfaces and supported by a frame of cleaning unit. The base portion includes the opposite side portions fixed to the opposite side surfaces of the support bar.

An air passage may be formed in the support bar, pressurized air being directed between the pressure pad and the support bar through the air passage so that the pressure pad can be deformed by means of the pressured air to be convex toward the subject.

The subject may comprise a plate cylinder in an offset printing press.

The subject may be an impression cylinder in an offset printing press.

The subject may comprise a paper to be printed.

It is preferable that the cleaning fabric is thick.

DETAILED DESCRIPTION OF THE PREFERRED EMBODIMENTS

Figure 1:
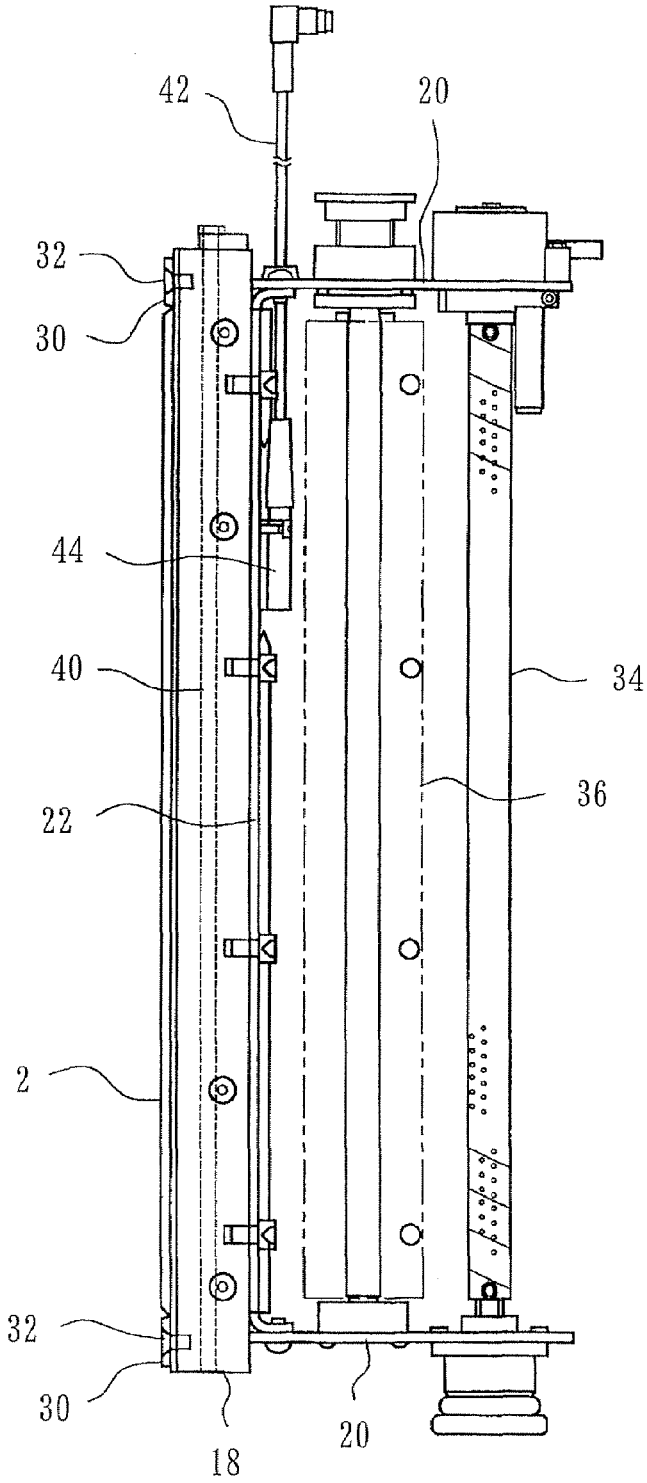
FIG. 1 is a plan view of a preferred embodiment of the invention.
Figure 2:
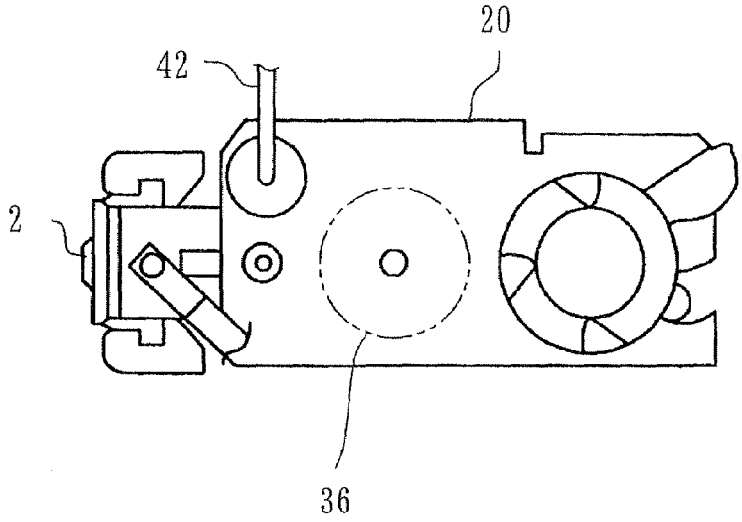
FIG. 2 is a side view of the cleaning apparatus of FIG. 1.
Figure 4:
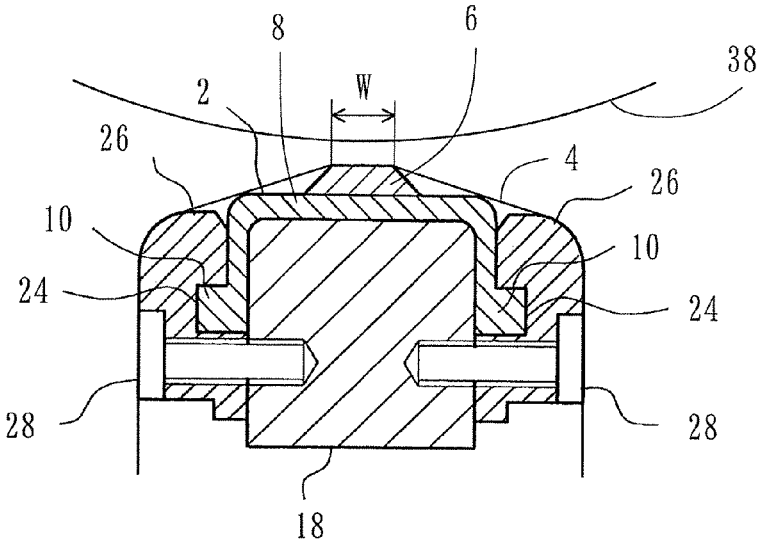
FIG. 4 is a cross sectional view of the pressure pad of FIG. 1.

Turning now to the drawings, FIG. 1 illustrates a cleaning apparatus according to the invention. The cleaning apparatus includes a pressure pad 2 for a cleaning fabric 4, as shown in FIG. 4.

The pressure pad 2 comprises a particular portion 6 formed on a base portion 8 to protrude from the base portion 8. The base portion 8 has a predetermined hardness. The particular portion 6 has a predetermined hardness which is lower than the hardness of the base portion 8. The base portion 8 is formed of rubber. The particular portion 6 is also formed of rubber.

In the embodiment, the base portion 8 is formed of NBR rubber having a hardness (e.g., shore hardness) of 50 to 60 degrees and a thickness of about 2.5 mm. The particular portion 6 is formed of NBR rubber having a hardness (e.g., shore hardness) of 20 to 40 degrees and a thickness of 2.0 to 4.0 mm. In addition, the particular portion 6 and the base portion 8 are formed integrally with each other by being pressed with a predetermined high pressure and under a predetermined temperature.

Figure 6:
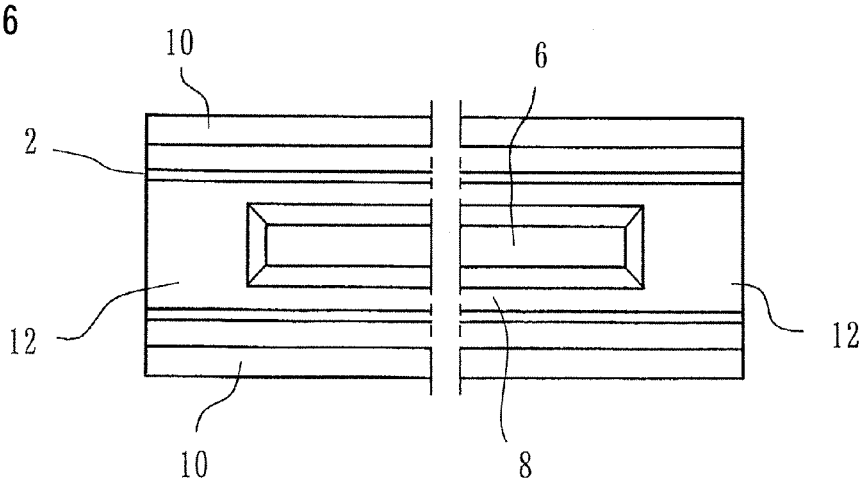
FIG. 6 is an elevational view of the pressure pad of FIG. 1.
Figure 7:
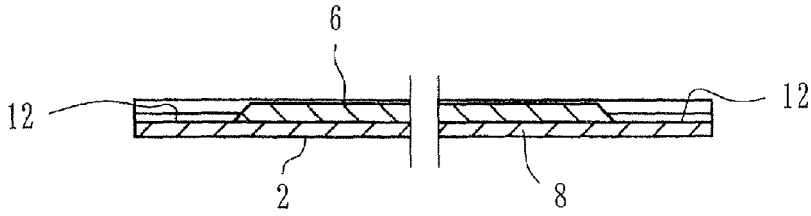
FIG. 7 is a longitudinal sectional view of the pressure pad of FIG. 6.

Furthermore, the base portion 8 has a predetermined width end includes opposite side portions 10 to be fixed. The particular portion 6 has a predetermined width W which is less than the width of the base portion 8, to be positioned between the opposite side portions 10 of the base portion 8. In addition, the base portion 8 has a predetermined length and includes opposite end portions 12, as shown in FIG. 6 and FIG. 7. The particular portion 6 has a predetermined length which is less than the length of the base portion 8, to be positioned between the opposite end portions 12 of the base portion 8.

Figure 8:
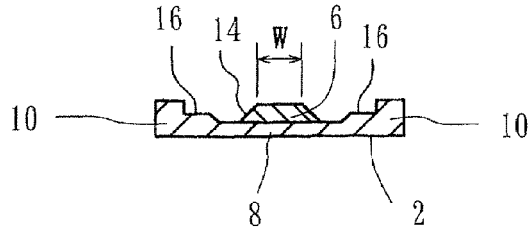
FIG. 8 is a cross sectional view of the pressure pad of FIG. 6.

The base portion 8 is formed into a flat board to include a flat back surface and a stepped front surface by which a central portion 14 and transitional portions 16 are formed between the opposite side portions 10, as shown in FIG. 8. The central portion 14 is thinner than the transitional portions 16 which are thinner than the opposite side portions 10.

The base portion 8 is then deformed and curved to be channel shaped. The particular portion 6 is disposed outwardly of the base portion 8. In this connection, the cleaning apparatus further includes a support bar 18 supported by a frame of cleaning unit. The frame includes side plates 20 connected by a back up bar 22 on which the support bar 18 is mounted to be supported. The base portion 8 includes the opposite side portions 10 opposed to the opposite side surfaces of the support bar 18 when being deformed and curved. In addition, the opposite side portions 10 protrude by the thickness to be fitted into grooves 24 formed in clamp bars 26. The clamp bars 25 and the support bar 18 are fixed to each other by means of screws 28 so that the opposite side portions 10 can be clamped between the clamp bars 26 and the support bar 18 to be fixed to the opposite side surfaces of the support bar 18.

Figure 3:
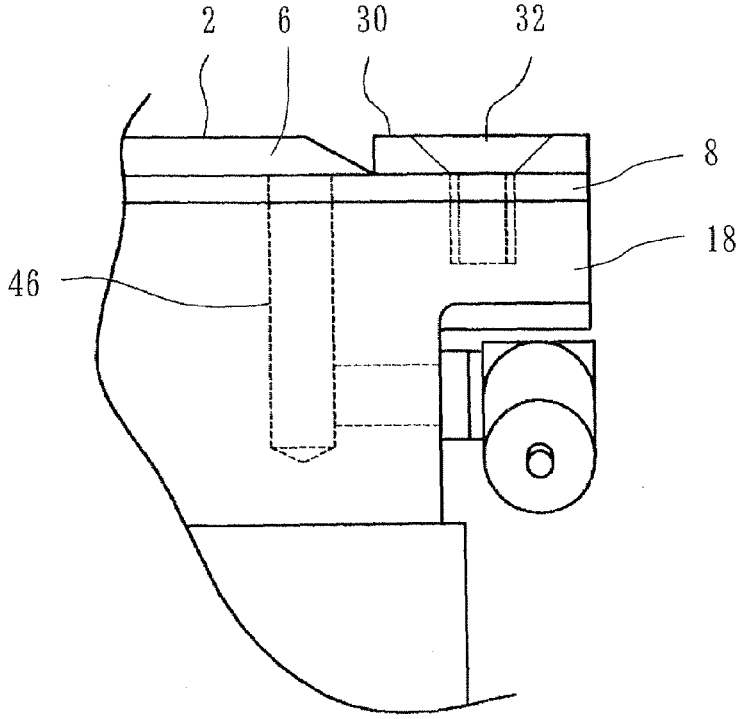
FIG. 3 is a partially enlarged view of the cleaning apparatus of FIG. 1.

Furthermore, the base portion 8 includes the opposite end portions 12 with which plates 30 are engaged, as shown in FIG. 3. The plates 30, the base portion 8 and the support bar 18 are fixed to each other by means of screws 32.

The cleaning fabric 4 is directed to a take up shaft 34 from a supply roll 30 through the pressure pad 2 to be engaged with the particular portion 6 of the pressure pad 2. The cleaning fabric 4 is then nipped between the particular portion 6 and a subject to clean the subject with the cleaning fabric 4, as described below. The subject comprises a plate cylinder 38 in an offset printing press.

Figure 5:
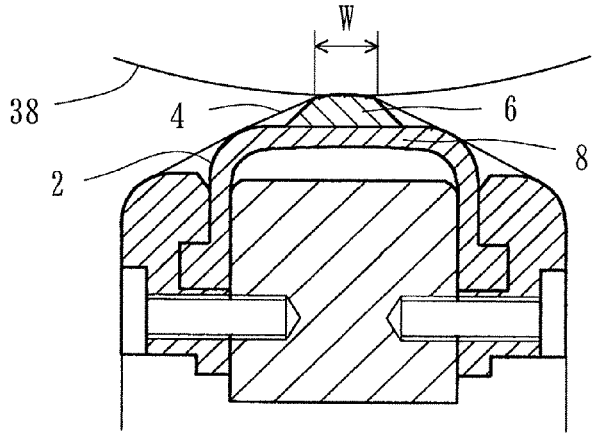
FIG. 5 is a cross sectional view of the pressure pad of FIG. 4 when pressurized air is directed.

In the embodiment, an air passage 40 is formed in the support bar 18 to extend longitudinally of the support bar 18 and open to the pressure pad 2 at positions spaced from each other. Pressurized air is supplied to the air passage 40 from a supply of air through an air hose 42 and a junction 44 which is disposed at the back of the back up bar 22. The pressurized air is therefore directed between the pressure pad 2 and the support bar 18 through the air passage 40 so that the pressure pad 2 can be deformed by the pressurized air to be convex toward the plate cylinder 38, as shown in FIG. 5. Accordingly, the cleaning fabric 4 is nipped between the particular portion 6 and the outer surface of the plate cylinder 38 with a nip width W which corresponds to the width of the particular portion 6. Furthermore, the plate cylinder 38 is rotated in a direction to wipe and clean the outer surface of the plate cylinder 38 with the cleaning fabric 4.

The pressurized air is then discharged through an air passage 46 shown in FIG. 3 so that pressure pad 2 can be restored to the position shown in FIG. 4 to be spaced from the outer surface of the plate cylinder 38. The take up shaft 34 is rotated intermittently by gears and a one way clutch so that the used fabric 4 can be fed to and taken up about the take up shaft 34.

The cleaning fabric 4 may be fed in the direction in which the plate cylinder 38 is rotated when the cleaning fabric 4 is nipped between the particular portion 6 and the outer surface of the plate cylinder 38, to wipe and clean the outer surface of the plate cylinder 38 by means of the difference in speed of the plate cylinder 38 and the cleaning fabric 4.

In the embodiment, the plate cylinder 38 includes a printing plate put thereon. The printing plate includes an ink repellent silicon layer which is peeled off partially by laser. The cleaning apparatus cleans the outer surface of the plate cylinder 38 to remove silicon particles issued from the silicon layer.

In this connection, it should be recognized that the base portion 8 has the high hardness to keep the particular portion 6 and the cleaning fabric 4 being opposed to the outer surface of the plate cylinder 38. The cleaning fabric 4 can therefore be reliably nipped between the particular portion 6 and the outer surface of the plate cylinder 38 to clean the outer surface of the plate cylinder 38 with the cleaning fabric 4. In addition, the particular portion 6 has the low hardness lower than the hardness of the base portion 8, as described above. The cleaning fabric 4 is therefore pressed not hard but softly against the printing plate by the particular portion 6. Accordingly, the printing plate cannot be scratched and damaged with the silicon particles sandwiched between the cleaning fabric 4 and the printing plate. The particular portion 6 results in a cushion effect on the printing plate.

In addition, the base portion 8 has the hardness (e.g., shore hardness) of 50 to 60 degrees and the thickness of about 2.5 mm, as described above. These values are suitable to make the pressure pad 2 deformed by the pressurized air and keep the particular portion 6 and the cleaning fabric 4 being opposed to the outer surface of the plate cylinder 38. The particular portion 6 has the hardness (e.g., shore hardness) 20 to 40 degrees and the thickness of 2.0 to 4.0 mm, as also described above. These values are suitable to make the cleaning fabric 4 pressed not hard but softly against the printing plate by the particular portion 6.

The apparatus is therefore adequate to clean the outer surface or printing plate of the plate cylinder 38 involving the silicon layer and the silicon particles. Unlike the U.S. Patents described above, the apparatus does not need the brush having the special structure, to be low in installation cost. The apparatus does not need the cleaning fabric formed of special fibers, to be low in running cost.

Furthermore, the particular portion 6 has the low hardness which makes the cleaning fabric 4 pressed uniformly against the outer surface of the plate cylinder 38. The low hardness is also helpful for adjustment of the nip width W and the nip pressure with which the cleaning fabric 4 is nipped between the particular portion 6 and the outer surface of the plate cylinder 38.

It should also be understood that the cleaning apparatus may be arranged to keep the pressure pad 2 being deformed by the pressurized air and move the whole cleaning unit toward and from the outer surface of the plate cylinder 38.

Figure 11:
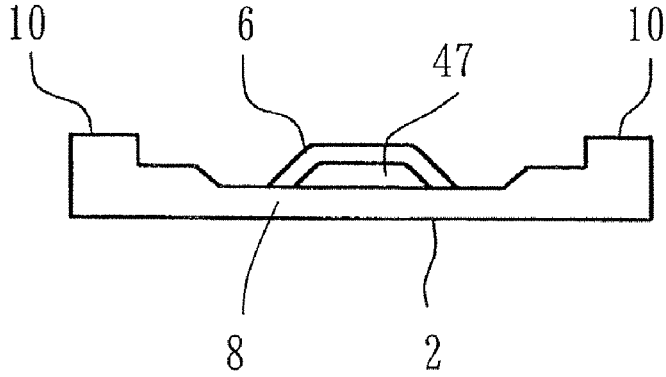
FIG. 11 is a cross sectional view of another embodiment.

The pressure pad 2 may include a hollow portion 47 formed between the particular portion 6 and the base portion 8, an shown in FIG. 11, to result in a cushion effect on the plate cylinder.

The particular portion may be formed of fabric and felt and adhered to the base portion 8 formed of rubber.

In general, the cleaning fabric 4 comprises SONTARA No. 8802 of Dupont having a thickness of about 0.32 mm. It is preferable to utilize SONTARA No. 8005 of Dupont having a thickness of about 0.65 mm as the cleaning fabric 4 to result in a cushion effect. In particular, it is required in a printing press for making electronic parts such as liquid crystal glass filters to clean the outer surface of the cylinder in a clean room. In this case, it is preferable to utilize a sponged fabric such as RUBYCELL CLEAN RK-800 of Nissei having a thickness of 0.7 mm as the cleaning fabric 4 to prevent powders from generating.

Figure 9:
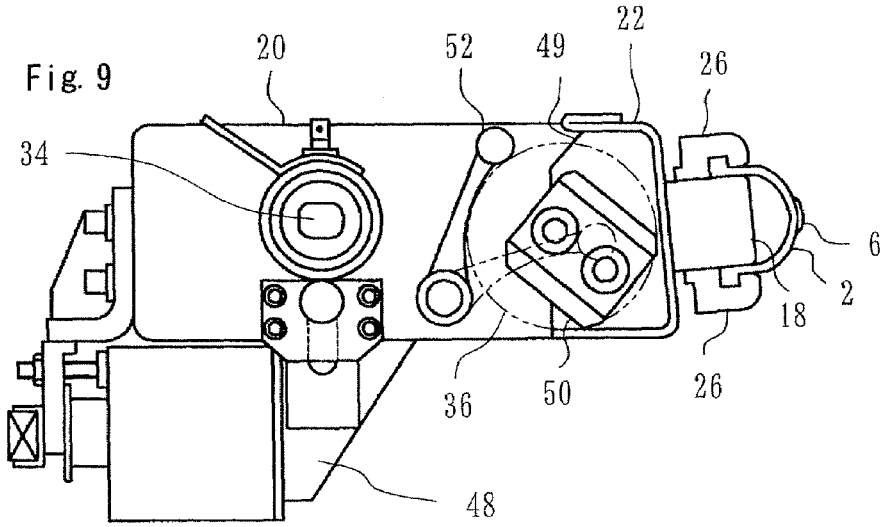
FIG. 9 is a side view of another embodiment.

In another embodiment shown in FIG. 9, the cleaning fabric 4 is directed to the take up shaft 34 from the supply roll 36 through the pressure pad 2, as in the case of the cleaning apparatus of FIG. 1. The cleaning apparatus includes means 48 for moving the whole cleaning unit toward and from the outer surface of the plate cylinder.

In the embodiment, the cleaning apparatus further includes the side plates 20 connected by the back up bar 22 on which the support bar 18 is mounted to be supported, as also in the case of the cleaning apparatus of FIG. 1. The pressure pad 2 comprises the particular portion 6 formed on the base portion 8 which is clamped between the clamp bars 26 and the support bar 18. The back up bar 22 is channel shaped to include upper and lower bent portions between which a vertical portion is formed. The upper bent portion is further bent upwardly to be two superposed layers. End plates 49 are fixed to the opposite end portions of the back up bar 22 by welding and fixed to the side plates 20 by screws.

The supply roll 36 includes protrusions protruding from the opposite end surfaces thereof. The protrusions comprise a core about which the cleaning fabric 4 is wound. The protrusions may comprise a member extending through the core. The protrusions may comprise members fitted into the core.

The protrusions are engaged with slotted guides 50 fixed to the inner surfaces of the end plates 49. The supply roll 36 is guided by means of the guides 50 to move toward the corner between the vertical portion and the lower bent portion of the back up bar 22 in accordance with the decrease in diameter of the supply roll 36 when the cleaning fabric 4 is supplied. A member 52 is engaged with the outer surface of the supply roll 36 to prevent the supply roll 36 from moving reversely.

Figure 10:
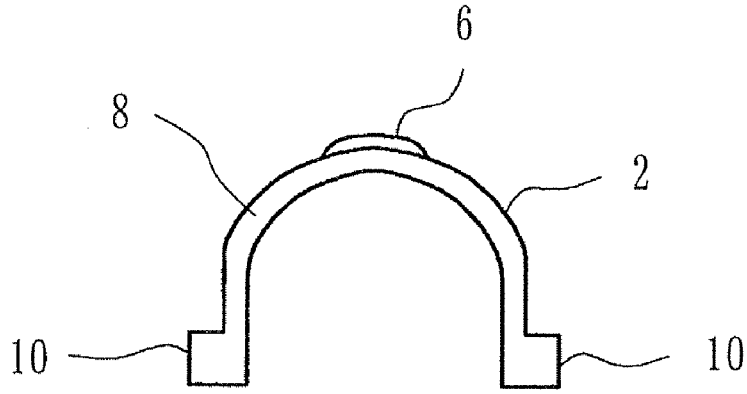
FIG. 10 is a cross sectional view of another embodiment.

The base portion 8 may be formed to be channel shaped, as shown in FIG. 10, to include the opposite side portions 10 fixed to the opposite side surfaces of the support bar 18.

Figure 12:
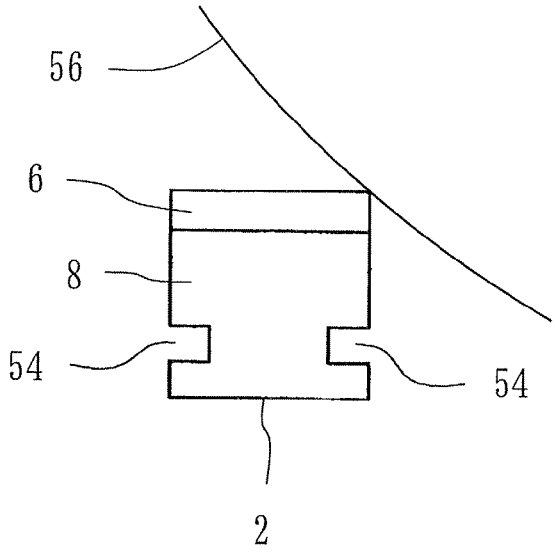
FIG. 12 is a cross sectional view of another embodiment.

In another embodiment shown in FIG. 12, the base portion 8 includes opposite side portions 54 to be fixed. The base portion 8 further includes a specified surface formed between the opposite side portions 54 and opposed the subject. The particular portion 6 comprises a layer extending throughout the specified surface of the base portion 8. In the embodiment, the subject comprises an impression cylinder 56 of the offset printing press.

Figure 13:
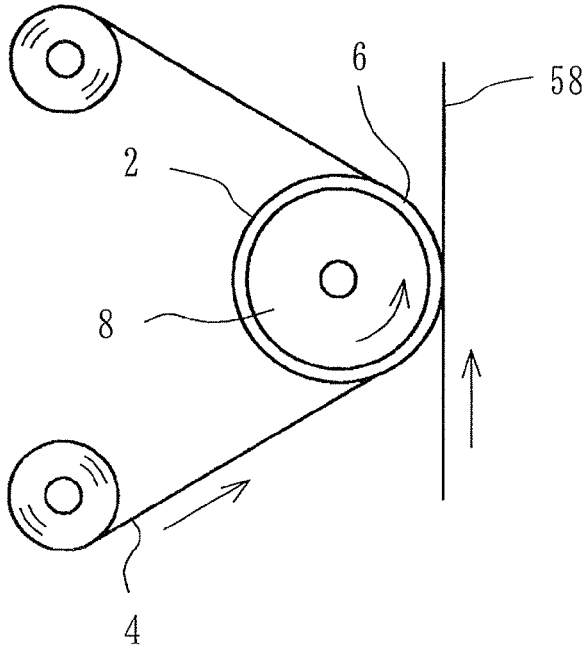
FIG. 13 is an explanatory view of another embodiment.

In another embodiment shown in FIG. 13, the base portion 8 is cylindrical. The particular portion 6 comprises a layer extending circumferentially of the base portion 8. The particular portion 6 has a hardness or 20 to 30 degrees. In the embodiment, the subject comprises a paper 58 to be printed. The cleaning fabric 4 is nipped between the particular portion 6 and the paper 58 to clean the surface of the paper 58 and remove lint with the cleaning fabric 4. In addition, the particular portion 6 and the base portion 8 are rotated in a direction. The cleaning fabric 4 is fed in the direction in which the particular portion 6 and the base portion 8 are rotated. The paper 58 is also fed in the direction in which the cleaning fabric 4 is fed, to wipe and clean the surface of the paper 58 by means of the difference in speed of the paper 58 and the cleaning fabric 4.

Figure 14:
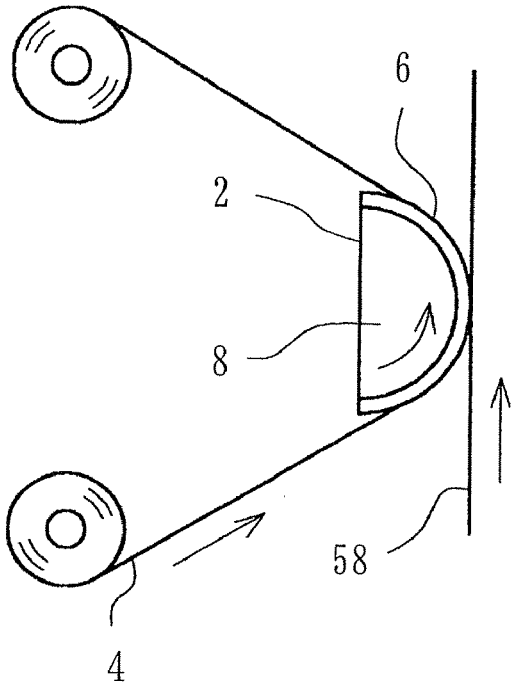
FIG. 14 is an explanatory view of another embodiment.

The base portion 8 may be semi cylindrical, as shown in FIG. 14.

The cleaning apparatus of FIG. 1 or FIG. 9 may be arranged to clean the outer surface of the paper.

It should be recognized that the cleaning fabric 4 is pressed not hard but softly against the paper 58 by the particular portion 6 having the low hardness, keeping the paper 58 from being lowered in quality.

The invention claimed is:

1. A cleaning apparatus for cleaning a plate cylinder in an offset printing press, said cleaning apparatus comprising:

a pressure pad, a cleaning fabric, the pressure pad comprising a particular portion formed on a base portion, the base portion having a predetermined shore hardness, the particular portion having a predetermined shore hardness of 20 to 40 degrees (20 to 40 HS), which is lower than the shore hardness of the base portion, wherein the base portion is formed of rubber, the particular portion being also formed of rubber, wherein the particular portion and the base portion are formed integrally with each other, and wherein the base portion has a predetermined width and includes opposite side portions to be fixed, the particular portion having a predetermined width which is less than the width of the base portion to be positioned between the opposite side portions of the base portion, and;

a support bar including opposite side surfaces and supported by a frame of the cleaning apparatus, the base portion including the opposite side portions fixed to the opposite side surfaces of the support bar, an air passage being formed in the support bar, pressurized air being directed between the pressure pad and the support bar through the air passage so that the pressure pad can be deformed by the pressurized air to be convex toward the plate cylinder, the cleaning fabric being nipped between the particular portion and the plate cylinder with a nip width to clean the plate cylinder with the cleaning fabric.

2. The cleaning apparatus as set forth in claim 1 wherein the base portion has a predetermined length and includes opposite end portions, the particular portion has a predetermined length which is less than the length of the base portion, to be positioned between the opposite end portions at the base portion.

3. The pressure pad as set forth in claim 1 further comprising a hollow portion formed between the particular portion and the base portion.

4. The cleaning apparatus as set forth in claim 1 wherein the base portion is formed into a flat board.

5. The cleaning apparatus as set forth in claim 4, the base portion being deformed to be channel shaped, the particular portion being disposed outwardly of the base portion.

6. The pressure pad as set forth in claim 1 wherein the base portion is formed to be channel shaped, the particular portion being disposed outwardly of the base portion.

7. The pressure pad as set forth in claim 1 wherein the base portion includes a specified surface formed between the opposite side portions and opposed to the plate cylinder, the particular portion comprising a layer extending throughout the specified surface of the base portion.

8. The pressure pad as set forth in claim 1 wherein the base portion is cylindrical or semi cylindrical.

9. The pressure pad as set forth in claim 8 wherein the particular portion comprises a layer extending circumferentially of the base portion.

10. The cleaning apparatus as set forth in claim 1 wherein the plate cylinder comprises a plate cylinder in an offset printing press.

11. The cleaning apparatus as set forth in claim 1 wherein the cleaning fabric is thick.

* * * * *